US008115702B2

(12) United States Patent
Kazuhiro et al.

(10) Patent No.: US 8,115,702 B2
(45) Date of Patent: Feb. 14, 2012

(54) PLASMA DISPLAY DEVICE AND DRIVING METHOD THEREOF

(75) Inventors: Ito Kazuhiro, Suwon-si (KR); Yoo-jin Song, Suwon-si (KR); Tae-wook Kim, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 938 days.

(21) Appl. No.: 12/124,749

(22) Filed: May 21, 2008

(65) Prior Publication Data

US 2008/0291130 A1 Nov. 27, 2008

(30) Foreign Application Priority Data

May 22, 2007 (KR) ..... 10-2007-0049621

(51) Int. Cl.
*G09G 3/28* (2006.01)

(52) U.S. Cl. ..... 345/60; 345/61; 345/62; 345/63; 345/64; 345/65; 345/66; 345/67; 345/68; 345/69; 345/70; 345/71; 345/72; 345/690; 315/169.4

(58) Field of Classification Search ..... 345/60–72, 345/690; 315/169.4
See application file for complete search history.

(56) References Cited

U.S. PATENT DOCUMENTS 5,745,086 A 4/1998 Weber
2005/0083262 A1 * 4/2005 Chae et al. ..... 345/60

FOREIGN PATENT DOCUMENTS

KR 10-0627391 9/2006

OTHER PUBLICATIONS

Korean Patent Abstracts for Registered Korean Patent No. KR 10-0627391; Publication No. 1020060055842 A; Date of Publication: May 24, 2006; in the name of Hak Ki Choi.

* cited by examiner

*Primary Examiner* — Richard Hjerpe
*Assistant Examiner* — Jeffrey Steinberg
(74) *Attorney, Agent, or Firm* — Christie, Parker & Hale, LLP

(57) ABSTRACT

A plasma display device and a method of driving the same, capable of reducing or preventing the deterioration of components such as a switching device, due to an overcurrent. In a reset period, in order to cause the voltage of a scan electrode to ramp down from a first voltage to a second voltage, a panel driver includes a falling ramp switch that repeats turn-on/turn-off operations, alternately coupling and de-coupling a low-level power supply to the scan electrode, resulting in a gradually falling ramp waveform. A switch controller generates a switching pulse to control the falling ramp switch. Each turn-on time of the switching pulse for the initial falling ramp waveform following a power-on of the plasma display device is controlled to be shorter than each turn-on time of the switching pulse for other falling ramp waveform.

16 Claims, 6 Drawing Sheets

PLASMA DISPLAY DEVICE AND DRIVING METHOD THEREOF

CROSS-REFERENCE TO RELATED APPLICATION

This application claims priority to and the benefit of Korean Patent Application No. 10-2007-0049621, filed on May 22, 2007, in the Korean Intellectual Property Office, the entire content of which is incorporated herein by reference.

BACKGROUND

1. Field of the Invention

The present invention relates to a plasma display device and a method of driving the same.

2. Discussion of Related Art

A plasma display device is a flat panel display device that can display characters or images using a gas discharge plasma wherein, according to the size of the display panel, more than several hundreds of thousands to several millions of pixels are arranged in a matrix format.

A conventional plasma display device is driven by dividing one image frame into a plurality of subfields, and gray levels are displayed by the combination of the subfields. Each subfield includes a reset period, an address period, and a sustain period.

As the number of subfields in the image frame is increased, a false contour, which is an important problem with the image quality of a PDP, can be reduced. Accordingly, studies continue to search for a method for increasing the number of subfields in order to reduce a false contour, as do other various studies for securing an operation margin in driving of a plasma display device. Among others, one is a method using a ramp reset waveform.

When using a ramp reset waveform, a falling ramp reset waveform is applied in a state where plenty of wall charges are accumulated on the whole panel using a weak discharge according to the application of a rising ramp reset waveform, so that only wall charges that are proper for an address operation in a subsequent address period are retained, and the remaining wall charges are erased, making it possible to perform a low voltage address operation.

Among driving signals for driving a plasma display panel, in particular, a scan electrode driving signal has a very complicated waveform including an erase waveform in an erase period, a reset waveform in a reset period, an address waveform in an address period, and a sustain waveform in a sustain period. In the case of the reset waveform, its voltage falls from a very high electric potential to a ground electric potential or an electric potential close to ground, so the difference between the starting electric potential and the ending electric potential of the scan electrode during the time its voltage falls is very large, causing a problem in that its current can stress the driving circuit.

SUMMARY OF THE INVENTION

Accordingly, there is a need for an improved plasma display device capable of reducing or preventing deterioration due to current stress. It is an aspect of an exemplary embodiment of the present invention to provide an improved plasma display device and a driving method thereof by reducing or preventing the deterioration of components such as a switching device, and relieving current stress from a driving circuit.

In particular, it is a further aspect of an exemplary embodiment of the present invention to provide an improved plasma display device and a driving method thereof, capable of relieving current stress applied to a driving circuit when a large reduction in voltage occurs during a falling ramp reset waveform of a scan electrode.

Also, it is a further aspect of an exemplary embodiment of the present invention to provide a plasma display device and a driving method thereof, capable of reducing or preventing stress due to the overcurrent right after the plasma display device powers on.

In order to accomplish the above and other aspects, according to a first exemplary embodiment of the present invention, a plasma display device comprises a plasma display panel with a plurality of discharge cells corresponding to an electrode. A panel electrode driver drives the electrode with a low level power source, a switch controller, and falling ramp switch coupled between the electrode and the low level power source. The switch controller generates a switching pulse that causes the falling ramp switch to repeatedly couple and decouple the electrode to the low level power source. This achieves a ramping reduction in the voltage of the electrode from a first voltage to a second voltage.

Herein, the respective turn-on period of the switching pulse (i.e., when the falling ramp switch couples the electrode to the low level power source) follows the equations below:

$$T=4a\times C^2/(I_{peak})^2$$

$$I_{peak}\leq I_r$$

($I_r$: Maximum current allowed by the falling ramp switch
a: Correction constant, $I_{peak}$: Peak current
T: Turn-on time, C: Panel capacitance)

According to a second embodiment, a plasma display device comprises a plasma display panel with a plurality of discharge cells corresponding to an electrode. A panel electrode driver drives the electrode with a low level power source, a switch controller, and falling ramp switch coupled between the electrode and the low level power source. The switch controller generates a switching pulse that causes the falling ramp switch to repeatedly couple and de-couple the electrode to the low level power source. This achieves a ramping reduction in the voltage of the electrode from a first voltage to a second voltage. In this second embodiment, the turn-on time of the switching pulse for an initial ramping reduction following a power-on of the plasma display device is shorter than the turn-on time of the switching pulse for other ramping reductions.

In the plasma display device according the first and second embodiments of the present invention, the electrode is a scan electrode that applies a reset waveform for resetting the discharge cells.

Also, the driving signals for the electrode include a reset period, an address period, and a sustain period. The first voltage may be a ground voltage, and the second voltage may be the lowest level voltage of the electrode during the reset period.

Also, the panel electrode driver can further include a sustain switch for generating a sustain waveform during the sustain period, and a rising switch for generating a rising ramp waveform during the reset period.

Also, the plasma display panel can further include a sustain electrode for generating a gas discharge together with the scan electrode, and an address electrode crossing the scan electrode and the sustain electrode.

Also, the panel electrode driver may be a scan electrode driver.

Also, the plasma display device may further include a sustain electrode driver for generating driving signals for the sustain electrode; and an address electrode driver for generating driving signals for the address electrode.

Also, the respective turn-on times of the switching pulse for the initial ramping reduction in the voltage of the electrode following a power-on of the plasma display device may be shorter than the respective turn-on times of the switching pulse for ramping reductions after the initial ramping reduction.

A third embodiment of the present invention includes a method of driving a plasma display device including a first electrode, a second electrode, and a third electrode crossing the first and second electrodes at a discharge cell, wherein an image frame comprises a plurality of subfields, the subfields including a reset period, an address period, and a sustain period. The method includes: (a) setting the first electrode to a first voltage; and (b) repeatedly coupling and de-coupling the first electrode to a low level power source in order to achieve a ramping reduction in a voltage of the first electrode from the first voltage to a second voltage, wherein the a time during which the first electrode is coupled to the low level power source follows the equations below:

$$T=4a\times C^2/(I_{peak})^2$$

$$I_{peak}\leqq I_r$$

($I_r$: Maximum current allowed through the first electrode;
a: Correction constant; $I_{peak}$: Peak current through the first electrode;
T: Time during which the first electrode is coupled to the low level power source;
C: Panel capacitance)

A fourth embodiment of the present invention includes a method of driving a plasma display device including a first electrode, a second electrode, and a third electrode crossing the first and second electrodes at a discharge cell, wherein an image frame comprises a plurality of subfields, the subfields including a reset period, an address period, and a sustain period. The method comprises (a) setting the first electrode to a first voltage; and (b) repeatedly coupling and de-coupling the first electrodes to a low level power source in order to achieve a ramping reduction in a voltage of the first electrode from the first voltage to a second voltage, wherein the ramping reduction during an initial subfield following a power-on of the plasma display device comprises a longer ramping time than the ramping reduction in another subfield.

In the method of driving the plasma display device according to the third and fourth embodiments of the present invention, the first electrode can have ground voltage following the power-on of the plasma display panel.

Also, the coupling and de-coupling can be done by applying a switching pulse to a falling ramp switch, wherein the falling ramp switch is coupled at one side to the first electrode, and coupled at a second side to the low level power source.

Also, the address period may include applying an addressing pulse to the first and third electrode, and the sustain period may include alternately applying a sustain discharge pulse to the first electrode and the second electrode.

Also, the first electrode may be a scan electrode for applying a reset waveform removing the wall charges of the discharge cell, the second electrode may be a sustain electrode for generating a sustain discharge together with the scan electrode, and the third electrode may be an address electrode for determining whether the discharge cell is turned on depending on display data.

BRIEF DESCRIPTION OF THE DRAWINGS

These and/or other aspects and features of the invention will become apparent and more readily appreciated from the following description of certain exemplary embodiments, taken in conjunction with the accompanying drawings of which.

DETAILED DESCRIPTION OF EMBODIMENTS

Figure 1:
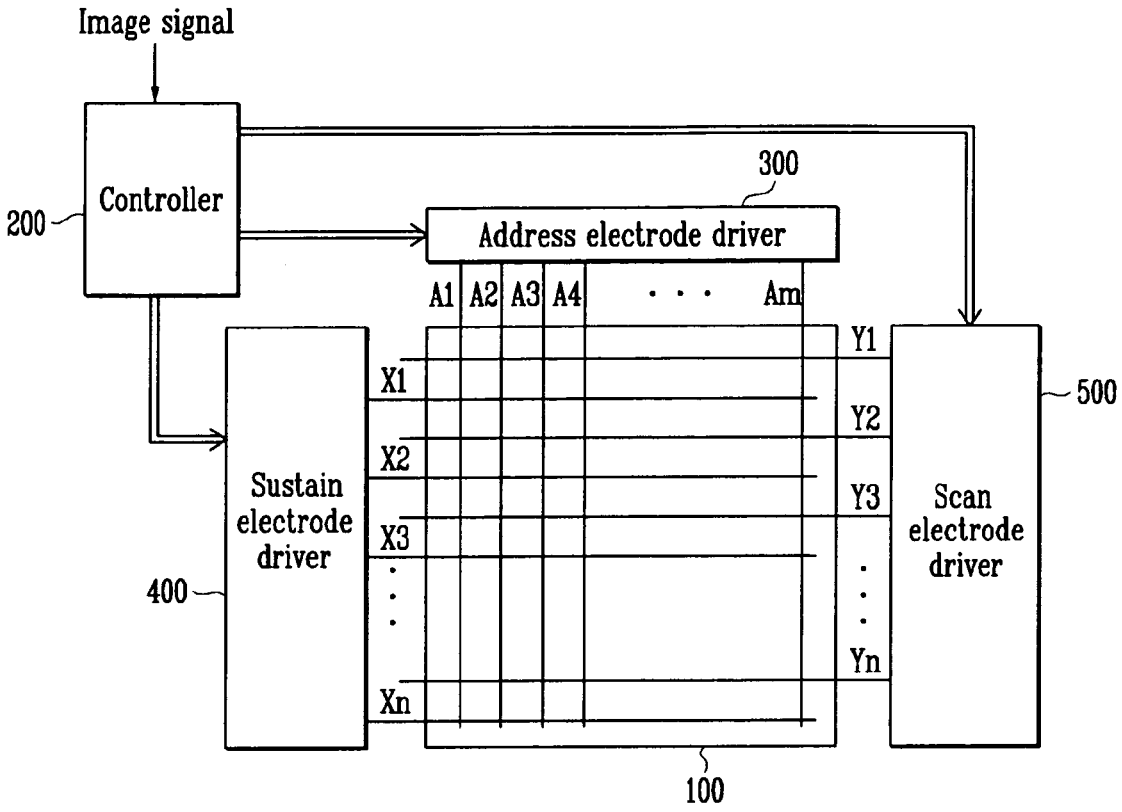
FIG. 1 is a block diagram of a three-electrode surface discharge type plasma display device according to an exemplary embodiment of the present invention.

Hereinafter, embodiments of the present invention will be described with reference to the accompanying drawings so that those skilled in the art to which the present invention pertains can easily carry out the present invention. However, the present invention may be modified in many different forms and it should not be limited to the embodiments set forth herein. Also, in the context of the present application, when an element is referred to as being "coupled to" another element, it can be directly coupled to the another element or be indirectly coupled to the another element with one or more intervening elements interposed therebetween. Like reference numerals designate like elements throughout the specification.

In order to reduce or prevent a current stress associated with the ramping voltage, the present applicant has previously proposed the improved technique of Korean Patent Application No. 10-2004-0095008. However, although the improved technique disclosed there has proposed a useful solution controllably driving a switch in order to prevent the current stress, it fails to discuss the numeral value to concretely regulate the switch.

Immediately following the power-on of a plasma display device, it is in a state where energy storage elements of a capacitor are empty, and a buffer operation by means of an overcurrent is not sufficient to create a reset waveform. However, the prior art has not presented a solution to this problem.

FIG. 1 is a block diagram of a plasma display device according to one embodiment of the present invention.

As shown in FIG. 1, the plasma display device according to an exemplary embodiment of the present invention includes a display panel 100, a controller 200, an address electrode driver 300, a sustain electrode driver 400, and a scan electrode driver 500. The plasma display panel 100 includes a plurality of address electrodes A1 to Am arranged to extend in a column direction, a plurality of sustain electrodes X1 to Xn and a plurality of scan electrodes Y1 to Yn arranged to extend in a row direction. The plurality of scan electrodes Y1 to Yn and the sustain electrodes X1 to Xn are arranged in pairs. Discharge cells are formed in regions where the adjacent scan electrodes and sustain electrodes cross the address electrodes.

The controller 200 receives image signals from an external circuit to output address driving control signals, sustain electrode driving control signals, and scan electrode driving control signals. The controller is driven by dividing one frame into a plurality of subfields, wherein the respective subfields include a reset period, an address period, and a sustain period, over time during the operation.

The address electrode driver 300 receives the address driving control signals from the controller 200 and generates display data signals for selecting discharge cells to be transmitted through the respective address electrodes. The sustain electrode driver 400 receives the sustain electrode driving control signals from the controller 200 and generates a driving voltage to be transmitted through the sustain electrodes X. The scan electrode driver 500 receives the scan electrode driving control signals from the controller 200 and generates a driving voltage to be transmitted through the scan electrodes Y.

The plasma display panel 100 of FIG. 1 can be embodied in a three-electrode surface discharge type plasma display panel configured with the scan electrode and the sustain electrode formed on the upper plate of the plasma display panel, and the address electrode formed on the lower plate thereof.

Figure 2:
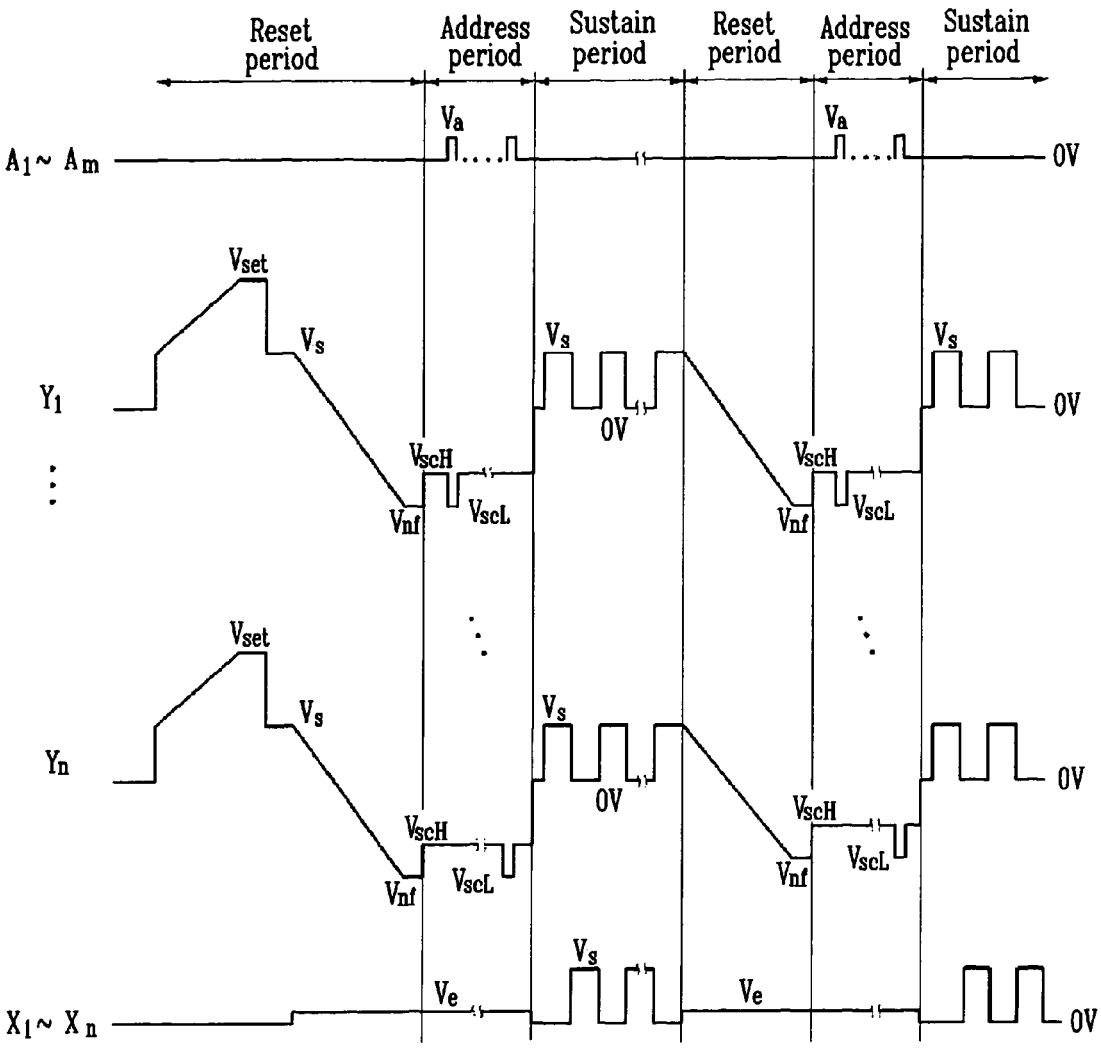
FIG. 2 is a diagram showing waveforms of a scan electrode driving signal and a sustain electrode driving signal for driving the plasma display panel of FIG. 1 according to an exemplary embodiment of the present invention.

FIG. 2 shows one example of the scan electrode driving signals and the sustain electrode driving signals for driving the three-electrode surface discharge type plasma display panel embodied in FIG. 1.

The reset period is when the wall charges formed in the previous sustain period are removed. During the reset period of a first subfield, a main reset waveform accumulates wall charges in the whole discharge cells and then removes them. During an auxiliary reset waveform, which occurs in subfields subsequent to the first subfield, the wall charges in the discharge cells discharged in the previous subfield are removed, without the process accumulating the wall charges in the discharge cells. The address period is the period during which the discharge cells to be displayed are selected, and the sustain period is the period during which a gas discharge occurs in the discharge cells selected in the address period.

First, during the reset period of the first subfield (a first subfield for each frame), i.e., when a main reset waveform is applied, a ramp voltage gradually rising in voltage from Vs to Vset to exceed a discharge initiating voltage, is applied to the scan electrode Y. While the ramp voltage is applied, weak discharges occur between the scan electrode Y and the address electrode A and the sustain electrode X. Owing to such a discharge, the negative (−) wall charges are accumulated on the scan electrode Y, and the positive (+) wall charges are accumulated on the address electrode A and the sustain electrode X.

Next, a ramp signal gradually falling in voltage from Vs to Vnf is applied to the scan electrode Y. At this time, the reference voltage (assumed to be 0V in FIG. 2) is applied to the address electrode A, and the sustain electrode X is biased with voltage Ve. And, in the discharge cell, if the discharge initiating voltage between the address electrode and the scan electrode is assumed to be Vfay, the voltage Vnf at the end of the falling ramp signal is the voltage corresponding to −Vfay.

Generally, in the discharge cell, if the voltage exceeds the discharge initiating voltage Vfay between the scan electrode and the address electrode, or between the scan electrode and the sustain electrode, a gas discharge occurs between the scan electrode and the address electrode, or between the scan electrode and the sustain electrode. In particular, when the discharge occurs during the slowly falling ramp voltage, the wall voltage in the inside of the discharge cells is reduced at the same speed as the falling ramp voltage. Such a principle is described in detail in U.S. Pat. No. 5,745,086 and thus, the detailed description thereof will be omitted.

Figure 3:
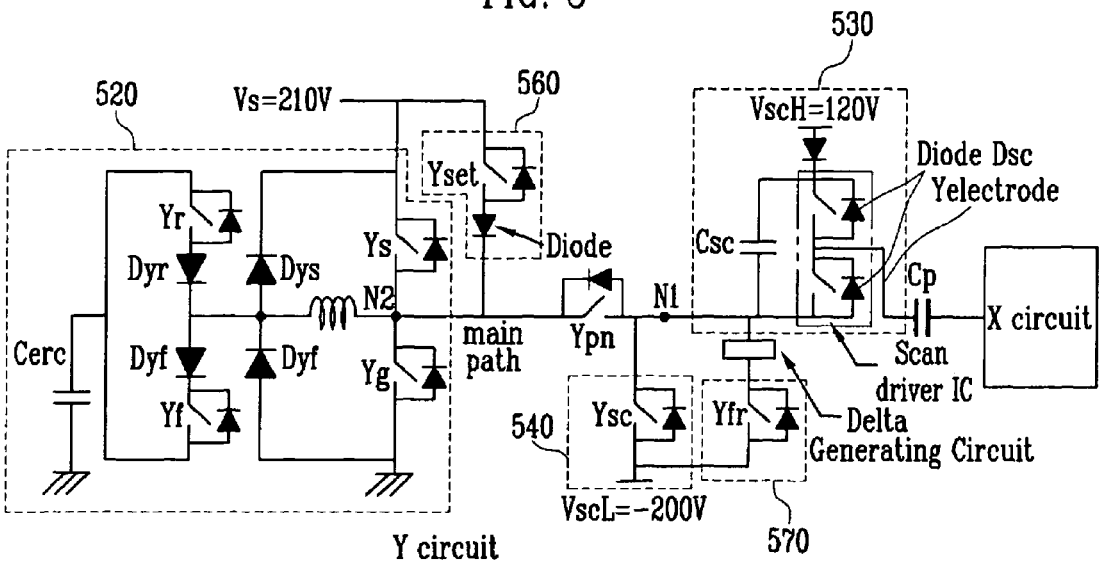
FIG. 3 is a circuit diagram showing the plasma display panel driver according to an exemplary embodiment of the present invention.

FIG. 3 is a circuit diagram showing a panel driver including a ramp reset unit for applying a ramp waveform to the scan electrode Y. This diagram shows the scan electrode driver circuit coupled to a panel capacitor Cp, which represents the capacitance between the Y electrode and an X electrode coupled to an X circuit block.

The node N2 between a sustain switch Ys and a ground switch Yg can be coupled to a power recovery circuit including a capacitor (e.g., energy recovery capacitor Cerc) and/or an inductor, and can use the LC resonance between the panel capacitance and the inductor to improve the efficiency of power consumption.

In FIG. 3, when viewed from a node N1 between a scan capacitor Csc and a switch Ysc, a left part functions as a sustain driver 520, an upper side part functions as a high level scan signal supplier 530, and a lower side part functions as a low level scan signal supplier 540.

A scan driver IC is coupled to the high level and low level scan signal suppliers 530 and 540, making it possible to drive a scan electrode used for the display.

Also, the sustain driver 520 is coupled to the node N1 via a main path, wherein a rising ramp switch Yset generating a ramp waveform rising in the reset period and a falling ramp switch Yfr generating a ramp waveform falling therein is coupled to the main path.

The sustain driver 520 generates an AC sustain discharge pulse using a sustain switch Ys coupled to a high level power source Vs and a ground switch Yg coupled to a low level power source 0V.

The high level scan signal supplier 530 includes a scan capacitor Csc of which one end is coupled to a high level scan power source VscH, and the other end is coupled to the scan electrode Y of the plasma display panel through the scan driver IC. The low level scan signal supplier 540 includes a scan switch Ysc of which one end is coupled to a low level scan power source VscL, and the other end is coupled to the scan electrode Y of the plasma display panel through the scan driver IC.

Also, the high level scan signal supplier 530 can further include a diode Dsc for blocking the current path in the reverse direction between the high level scan power source VscH and the scan capacitor Csc. When the scan switch Ysc is turned on, the scan capacitor Csc has a voltage of VscH-VscL.

Next, the principle used to apply the rising ramp waveform and the falling ramp waveform using the rising/falling ramp switches will be described. In the following description, some of the details about the waveforms applied to the sustain electrode and the address electrode are omitted.

First, the rising ramp switch Yset of a rising reset unit 560 is turned on during the reset period to maintain an on-state during the rising period in the reset period. Then, the waveform gradually increases to the Vset voltage while the rising ramp switch Yset maintains the on-state. Next, the falling ramp switch Yfr of a falling reset unit 570 is turned on to likewise maintain an on-state during the falling period in the reset period. Then, the waveform gradually reduces to a VscL voltage (=Vnf voltage) while the Yfr switch maintains the on-state.

Hereinafter, the process to obtain ramp waveforms having a slope, which may be predetermined, using the ramp switches will be described in detail. In particular, the method using a falling ramp switch will be described.

Figure 4:
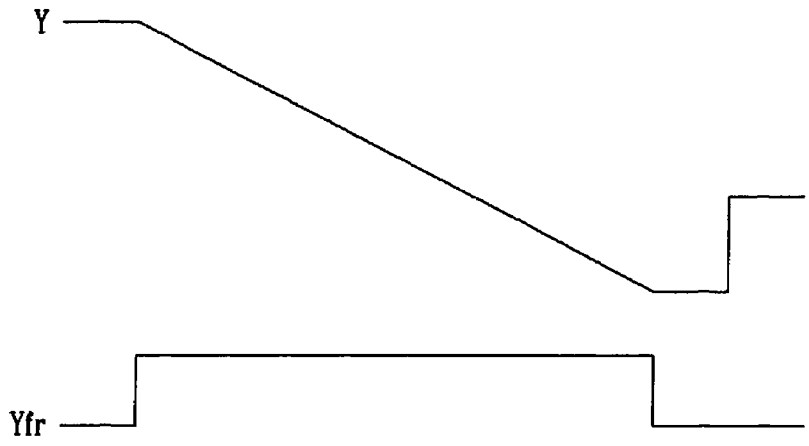
FIGS. 4 and 5 are diagrams showing a ramp waveform generated depending on switching pulses for the falling ramp switch of FIG. 3.
Figure 5:
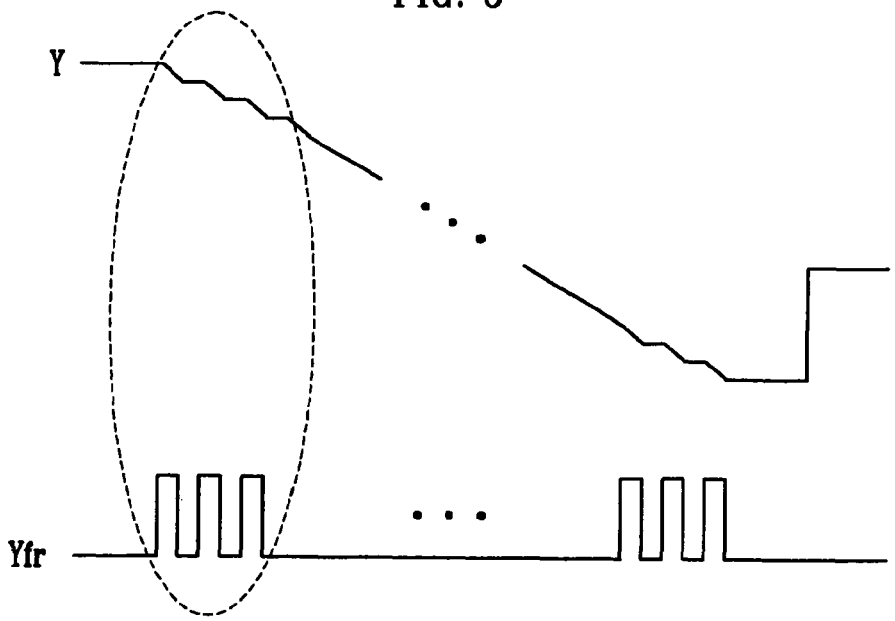

FIGS. 4 and 5 are views showing ramp waveforms depending on driving signals of the falling ramp switch.

As shown in FIG. 4, Y represents an output waveform on a Y electrode, and Yfr represents a signal applied to the gate of the falling ramp switch Yfr in the circuit in FIG. 3. When the signal Yfr is high, the switch Yfr in FIG. 3 is closed. In FIG. 4, the output waveform Y reduces in a substantially linear fashion during the period when the switch Yfr in the circuit in FIG. 3 is closed. In other words, when the switch Yfr is turned on (or closed), the output voltage falls at a ramp slope (e.g., a predetermined ramp slope).

FIG. 5 shows the behavior of the output waveform Y when the falling ramp switch Yfr has a switching pulse shape where turn-on and turn-off are alternately repeated. As shown in FIG. 5, as the output waveform Y with this switching signal Yfr is repetitive, a ramp down waveform (or a falling waveform) with a serrated shape can be obtained, wherein the voltage of the output waveform Y reduces for a period that may be predetermined, and then is maintained, and again is reduced for a period that may be predetermined, and then is maintained, etc.

Figure 6:
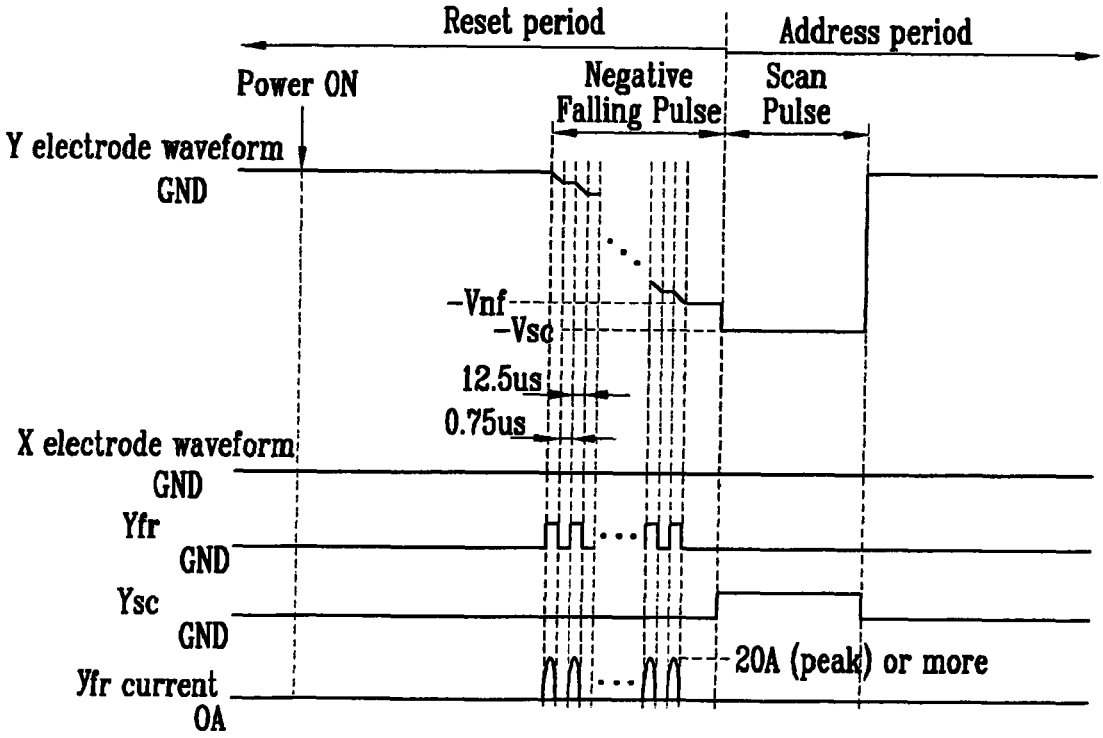
FIG. 6 is a diagram showing waveforms of the respective switching pulses and the scan electrode driving signals including the ramp waveform generated depending on the switching pulses of FIG. 5, without limitation of turn-on period.

FIG. 6 shows the switching pulse for the failing ramp switch (Yfr) and the current flowing to the falling ramp switch (Yfr current) together with the X electrode driving signals and the Y electrode driving signals, when falling from a first voltage, which may be predetermined (ground voltage GND in FIG. 6), to a second voltage, which is at the lowest level (−Vnf or VscL), using the falling ramp switch Yfr when a plasma display panel is powered on. However, the present invention is not limited thereto. As shown, when the plasma display panel is powered on, a rising ramp generally does not exist but it directly falls from the ground voltage to the lowest scan voltage (−Vnf or VscL).

When the plasma display panel is powered on, it is in a state where the capacitor Csc in the driving circuit is not sufficiently filled with energy storage elements (charge and electric field), so it is difficult to expect a sufficient reaction to provide instantaneous high current using the capacitor Csc.

Therefore, the voltage potential between the ground voltage and the lowest scan voltage VscL is converted into the overcurrent flowing through the falling ramp switch so that it directly applies stress to the falling ramp switch. The stress by means of the overcurrent may also seriously affect a Zener diode, etc., coupled to the falling ramp switch Yfr.

Figure 7:
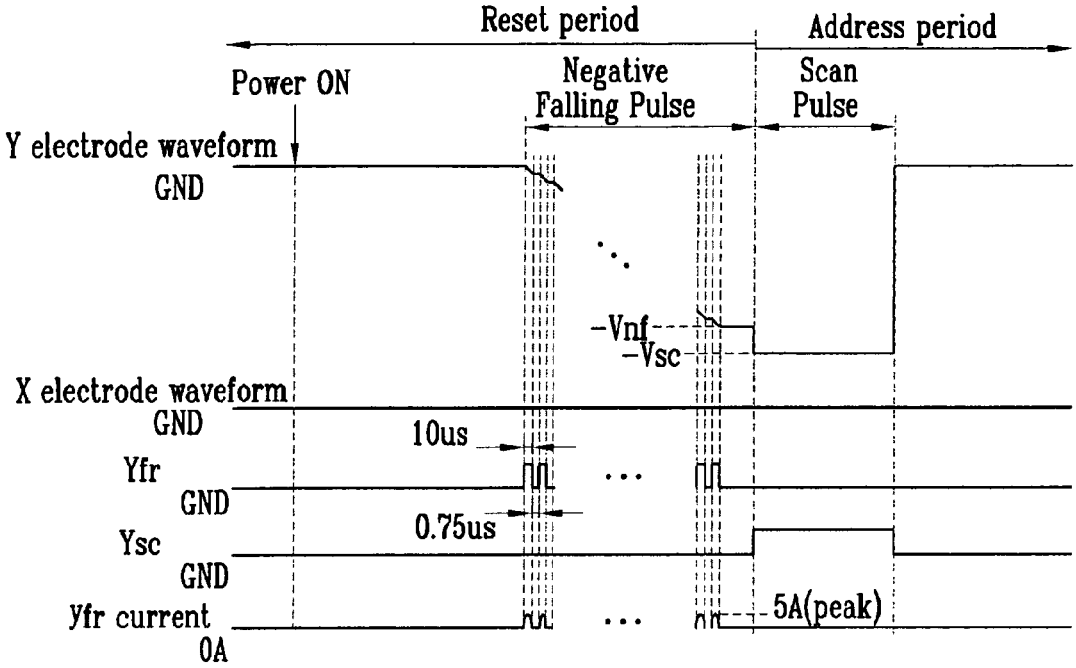
FIG. 7 is a diagram showing waveforms of the respective switching pulses and the scan electrode driving signals including the ramp waveform generated depending on the switching pulses of FIG. 5, having limitation of turn-on period.

FIG. 7 shows signals when the turn-on time of the falling ramp switch Yfr is limited in order to prevent the overcurrent stress. As shown, it is appreciated that if the turn-on time of the switching pulse for the falling ramp switch is limited to 10 μs or less, the peak current flowing through the falling ramp switch Yfr is limited to 5 A, reducing or preventing the overcurrent stress.

To the contrary, although the driving method as shown has a disadvantage that the falling time of the falling ramp of the Y electrode driving signal is extended, in the first Y electrode driving signal after the plasma display panel is powered on, a waveform for erasing is not used and the falling ramp is directly generated from the ground electric potential so that a sufficient time for offsetting the falling time of the extended falling ramp is available.

Now, when the turn-on time of the falling ramp switch Yfr is limited as shown in FIG. 7, an exemplary method prescribing the turn-on time of the falling ramp will be described.

If the current flowing to the falling ramp switch from the turn-on thereof to the turn-off thereof is approximated as a continuous, linearly increasing sawtooth wave, the relation between time t and current I can be represented by Equation 1, the linear function having a fixed slope c:

$$I=ct. \qquad \text{Equation 1}$$

Meanwhile, if the plasma display panel is viewed as one capacitor, the amount of charge Q to be discharged from the plasma display panel when falling from a first voltage to a second voltage, can be expressed by Equation 2:

$$Q=C\Delta V \qquad \text{Equation 2}$$

where C is the panel capacitance, and ΔV=first voltage−second voltage.

Assuming that the amount of charge Q discharged from the plasma display panel is divided into n turn-on periods, the amount of unit charge $Q_u$ discharged at one turn-on period can be expressed by Equation 3:

$$Q_u=C\Delta V/n \qquad \text{Equation 3}$$

Figure 9:
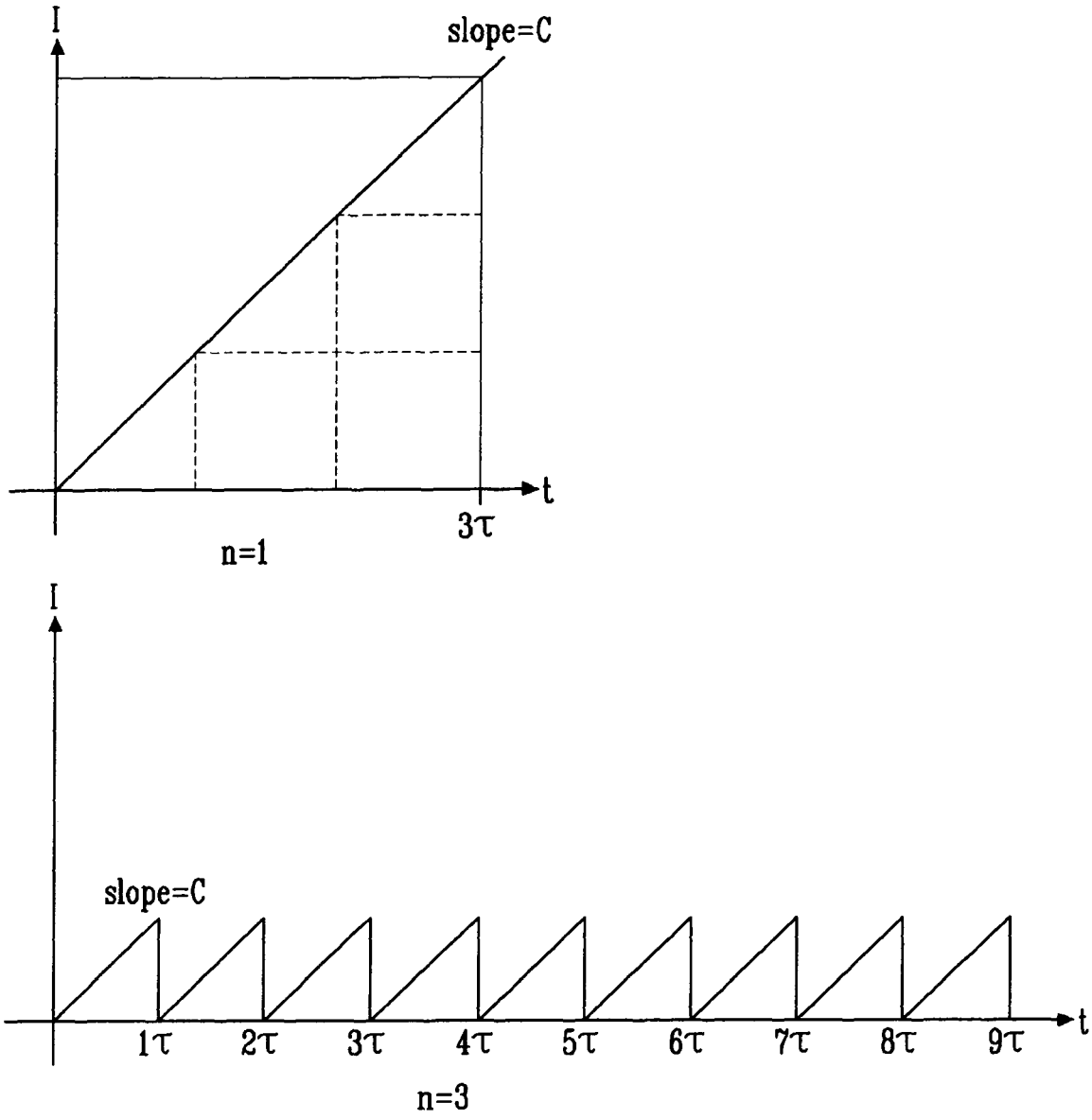
FIG. 9 is a concept view showing the relation between the frequency of turn-on and the time required in a path having a linear slope, in order to discharge the same amount of charge Q.

Herein, the amount of charge in the unit charge $Q_u$ is discharged during the unit turn-on time of the switching pulse applied to the falling ramp switch Yfr, wherein if the current has a triangular shape, such as the sawtooth waveform of FIG. 9 and as described by equation 1 accordingly, the amount of unit charge $Q_u$ flowing through the falling ramp switch Yfr during the unit turn-on time can be expressed by Equation 4:

$$Q_u=(1/2)T_u\times I_{pu} \qquad \text{Equation 4}$$

where $I_{pu}$ is the peak current generated during the unit turn-on time, and $T_u$ is the unit turn-on time.

Substituting equation 3 into equation 4 results in Equation 5:

$$(1/2)T_u\times I_{pu}=C\Delta V/n, \text{ and therefore,}$$

$$I_{pu}=2C\Delta V/(T_u\times n). \qquad \text{Equation 5}$$

Herein, in order to disclose the relationship between n and $T_u$ and discharge the same amount of charge Q, the relation between the time required for the path having the fixed linear slope and turn-on times is graphically shown in FIG. 9.

The charge, which is the area under the current-time curve, can be appreciated in FIG. 9 as having a square relationship with the time. For example, if the amount of unit charge $Q_u$ is discharged by turning on the switch once, it needs time $T_1=\tau$; if it is discharged by turning it on twice, it needs time $T_1=4\tau$; and if it is discharged by turning it on three times, it needs time $T_1=9\tau$. In other words, when $T_1$ has a fixed value, the relationship between n and $T_u$ can be expressed by Equation 6:

$$T_1=n^2\cdot T_u, \text{ and therefore,}$$

$$n=(T_1/T_u)^{1/2}. \qquad \text{Equation 6}$$

If Equation 6 is substituted into Equation 5 and solved for $T_u$, it can be expressed by Equation 7:

$$I_{pu}=2C\Delta V/[T_u\times(T_1/T_u)^{1/2}]$$

$$T_u=(4/T_1)\times(C\Delta V/I_{pu})^2. \qquad \text{Equation 6}$$

Herein, if ΔV and $T_1$ are considered to be fixed values according to the characteristics of the plasma display panel and the driving circuit, and thus are substituted by a constant "a," the relationship only between $T_u$, $I_{pu}$ and C can be expressed by Equation 8:

$$T_u=4a\times(C/I_{pu})^2 \qquad \text{Equation 8}$$

Therefore, in one embodiment of the present invention, each turn-on time of the switching pulses applied to the falling ramp switch Yfr of FIG. 3 follows Equation 9:

$$T=4a\times C^2/(I_{peak})^2$$

$$I_{peak}\leqq I_r \qquad \text{Equation 9}$$

($I_r$: Maximum current allowed by the falling ramp switch; a: Correction constant; $I_{peak}$: Peak current; T: Turn-on time; C: Panel capacitance.)

Figure 8:
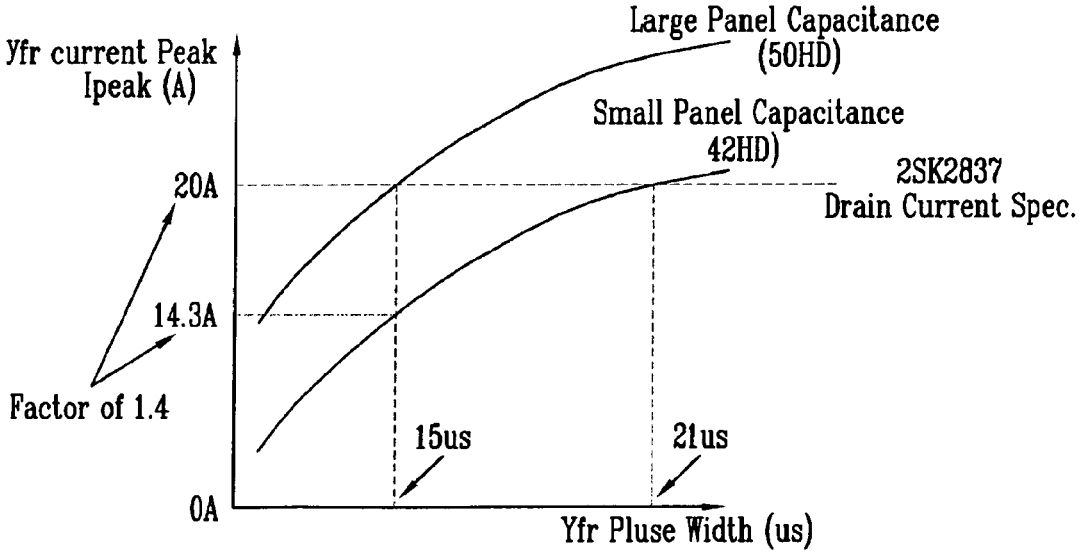
FIG. 8 is a graph showing current peak values depending on the limitation of the turn-on period of switching pulses for a falling ramp switch.

FIG. 8 shows the change of the preferred switching pulse width for the falling ramp switch Yfr according to panel capacitance Cp. In FIG. 8, if the limiting current of the switching element is 15 A, the switching pulse width is controlled to be not larger than 15 μs in the case of a 42" high definition panel where the capacitance is comparatively small, making it possible to reduce or prevent the deterioration of the switching element. However, it can be seen that, in the case of a 50" high definition panel (where the panel capacitance is comparatively large) having the same limiting current, since a peak current that exceeds the limiting current flows even with a switching pulse width of 15 μs, a shorter switching pulse width as compared to the smaller panel is required.

With the plasma display device and the driving method thereof according to the present invention, the current stress of the driving circuit can be relieved.

In particular, one aspect of an exemplary embodiment of the present invention is the relief of the current stress of the driving circuit when a falling voltage with a large deviation occurs in the reset waveform of the scan electrode.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A plasma display device comprising:

a plasma display panel comprising a plurality of discharge cells corresponding to an electrode; and a panel electrode driver for generating driving signals for the electrode, wherein the panel electrode driver comprises:

a falling ramp switch coupled at a first side to the electrode, and coupled at a second side to a low level power source; and a switch controller coupled to the falling ramp switch;

wherein the switch controller is adapted to generate a switching pulse to repeatedly turn on and turn off the falling ramp switch during a turn-on period and a turn-off period, respectively, to achieve a falling ramp waveform wherein a voltage of the electrode falls from a first voltage to a second voltage; and wherein the turn-on period of the switching pulse during the falling ramp waveform follows the equations below:

$$T=4a\times C^2/(I_{peak})^2$$

$$I_{peak}\leqq I_r$$

($I_r$: Maximum current allowed by the falling ramp switch; a: Correction constant; $I_{peak}$: Peak current through the falling ramp switch;

T: Time of the turn-on period; C: Panel capacitance).

2. The plasma display device as claimed in claim 1, wherein the electrode comprises a scan electrode, and the falling ramp waveform comprises at least a part of a reset waveform for resetting the discharge cells.

3. The plasma display device as claimed in claim 1, wherein the driving signals for the electrode are generated during a reset period, an address period, and a sustain period of a subfield, and wherein the first voltage is a ground voltage and the second voltage is a lowest level voltage of the electrode during the reset period.

4. The plasma display device as claimed in claim 3, wherein the panel electrode driver further comprises a sustain switch for generating a sustain waveform during the sustain period, and a rising ramp switch for generating a rising ramp waveform during the reset period.

5. The plasma display device as claimed in claim 2, further comprising:

a sustain electrode for generating a gas discharge together with the scan electrode, and an address electrode crossing the scan electrode and the sustain electrode.

6. The plasma display device as claimed in claim 5, further comprising:

a sustain electrode driver for generating driving signals for the sustain electrode; and an address electrode driver for generating driving signals for the address electrode, wherein the panel electrode driver is a scan electrode driver.

7. The plasma display device as claimed in claim 1, wherein the switch controller is adapted to control a turn-on time of the switching pulse for an initial falling ramp waveform following a power-on of the plasma display device to be shorter than a turn-on time of the switching pulse for falling ramp waveforms after the initial falling ramp waveform.

8. A method of driving a plasma display device including a first electrode, a second electrode, and a third electrode crossing the first and second electrodes at a discharge cell, wherein an image frame comprises a plurality of subfields, each subfield including a reset period, an address period, and a sustain period, the method comprising:

(a) setting the first electrode to a first voltage; and (b) repeatedly coupling and de-coupling the first electrode to a low level power source in order to achieve a falling ramp waveform wherein a voltage of the first electrode falls from the first voltage to a second voltage, wherein a time during which the first electrode is coupled to the low level power source follows the equations below:

$$T=4a\times C^2/(I_{peak})^2$$

$$I_{peak}\leqq I_r$$

($I_r$: Maximum current allowed through the first electrode; a: Correction constant; $I_{peak}$: Peak current through the first electrode T: Time during which the first electrode is coupled to the low level power source;

C: Panel capacitance).

9. The method of driving the plasma display device as claimed in claim 8, wherein the first voltage is a ground voltage following a power-on of a plasma display panel.

10. The method of driving the plasma display device as claimed in claim 8, wherein the coupling and de-coupling comprises applying a switching pulse to a falling ramp switch, wherein the falling ramp switch is coupled at one side to the first electrode, and coupled at a second side to the low level power source.

11. The method of driving the plasma display device as claimed in claim 8, wherein the address period comprises applying an addressing pulse to the first electrode and the third electrode, and the sustain period comprises alternately applying a sustain discharge pulse to the first electrode and the second electrode.

12. The method of driving the plasma display device as claimed in claim 8, wherein the first electrode comprises a scan electrode for applying a reset waveform removing wall charges of the discharge cell, the second electrode comprises a sustain electrode for generating a sustain discharge together with the scan electrode, and the third electrode comprises an address electrode for determining whether the discharge cell is turned on depending on display data.

13. A method of driving a plasma display device including a first electrode, a second electrode, and a third electrode crossing the first and second electrodes at a discharge cell, wherein an image frame comprises a plurality of subfields, each subfield including a reset period, an address period, and a sustain period, the method comprising:

(a) setting the first electrode to a first voltage; and (b) repeatedly coupling and de-coupling the first electrode to a low level power source in order to achieve a falling ramp waveform wherein a voltage of the first electrode falls from the first voltage to a second voltage, wherein the falling ramp waveform during an initial subfield following a power-on of the plasma display device comprises a longer ramping time than the falling ramp waveform in another subfield, wherein the ramping time during the initial subfield after the power-on follows the equations below:

$T=4a\times C^2/(I_{peak})^2$; and $I_{peak}\leq I_r$, wherein $I_r$ is a maximum current allowed through the first electrode, a is a correction constant, $I_{peak}$ is a peak current through the first electrode, T is the ramping time, and C is a panel capacitance.

14. The method of driving the plasma display device as claimed in claim 13, wherein the coupling and de-coupling comprises applying a switching pulse to a falling ramp switch, wherein the falling ramp switch is coupled at one side to the first electrode, and coupled at a second side to the low level power source.

15. The method of driving the plasma display device as claimed in claim 13, wherein in the address period comprises applying an addressing pulse to the first electrode and the third electrode, and the sustain period comprises alternately applying a sustain discharge pulse to the first electrode and the second electrode.

16. The method of driving the plasma display device as claimed in claim 13, wherein the first electrode comprises a scan electrode for applying a reset waveform removing wall charges of the discharge cell, the second electrode comprises a sustain electrode for generating a sustain discharge together with the scan electrode, and the third electrode comprises an address electrode for determining whether the discharge cell is turned on depending on display data.

* * * * *